United States Patent [19]

Cloyd

[11] 4,150,496

[45] Apr. 24, 1979

[54] PLASTIC TRAYS FOR DRYING FRUIT

[75] Inventor: Harold S. Cloyd, Erie, Pa.

[73] Assignee: Nosco Plastics, Inc., Jackson, Miss.

[21] Appl. No.: 769,572

[22] Filed: Feb. 17, 1977

[51] Int. Cl.[2] ..... F26B 25/10

[52] U.S. Cl. ..... 34/238; 15/104 R; 206/511; 206/509

[58] Field of Search ..... 34/237, 238; 206/509, 206/510, 511, 512; 15/104 R, 3; 6/12 M; 220/4 E, 4 D

[56] References Cited

U.S. PATENT DOCUMENTS

| | | | |
|---|---|---|---|
| 738,980 | 9/1903 | Bradley | 34/238 |
| 1,282,771 | 10/1918 | Dinesen | 34/237 |
| 3,251,460 | 5/1966 | Edmonds | 220/4 E X |
| 3,283,931 | 11/1966 | Gerraus | 34/238 X |
| 3,341,064 | 9/1967 | Ricci | 206/512 |
| 3,414,925 | 12/1968 | Stavros | 15/104 R |
| 3,545,097 | 12/1970 | Waltrich | 34/238 |
| 3,675,815 | 7/1972 | Rehrig | 206/512 X |
| 3,807,057 | 4/1974 | Noel | 34/237 |
| 3,908,852 | 9/1975 | Ricobene | 220/4 D X |
| 3,934,789 | 1/1976 | Allman | 34/238 X |

FOREIGN PATENT DOCUMENTS

| | | | |
|---|---|---|---|
| 979161 | 12/1975 | Canada | 15/3 |

*Primary Examiner*—Harold W. Weakley
*Attorney, Agent, or Firm*—Ralph Hammar

[57] ABSTRACT

The energy required for forced air drying fruits such as raisins, grapes, prunes, etc. is decreased by from 25 to 50 percent by substituting trays of molded thermoplastic resin for the wood trays now in use. Part of the increased efficiency comes from better contact of the air with the fruit and the balance of the improvement comes from the elimination of water absorption which has heretofore been present in the wood trays. The plastic trays also have much longer life.

5 Claims, 10 Drawing Figures

PLASTIC TRAYS FOR DRYING FRUIT

Figure 1:
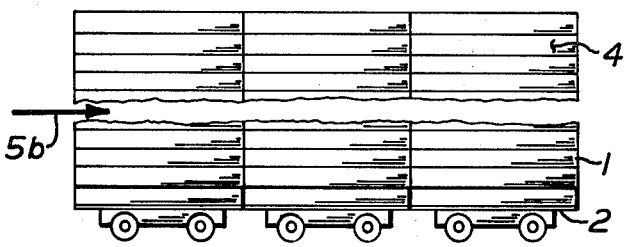

This invention is intended to increase the efficiency of drying fruits such as raisins, prunes, etc., by substituting trays of thermoplastic such as polypropylene for the wood trays now in use. The wood trays absorb considerable moisture which must be dried at the same time the fruit is dried. The wood trays provide very little exposure to the heated air on the bottom of the tray. The dried fruit sticks to the wood trays due to the syrup exhuded as the fruit dries, and must be scraped off, usually with metal scrapers, resulting in increased labor, loss of fruit, damage to the wood trays even to the extent of scraping off splinters and sometimes nails or nail heads which become mixed with the fruit and may subsequently be shipped with the final product.

These difficulties are eliminated by molding the trays of impact resistant thermoplastic resin such as polypropylene. The molded tray has a bed with a large number of slots which are too narrow to receive the fruit but are wide enough to permit the heated air to enter and extert a drying effect on the fruit on the bottom of the tray. The problem of the sticking of dried fruit to the tray is eliminated by a punch having projections which enter the bottoms of the slots and push the fruit away from the bottom of the tray. The dimensions of the slots is such that every fruit is lifted by at least two projections. This eliminates the labor of scraping fruit from the bottom of the tray and also eliminates the loss of fruit which is stuck so tightly to the bottom of the tray that it cannot be scraped loose, as well as possible contamination of the final product with splinters, nails or nail heads.

In the drawing

Figure 2:
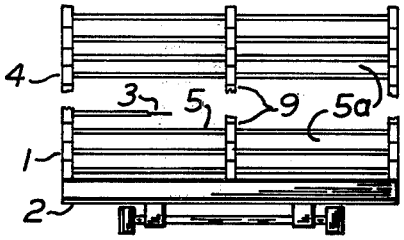
Figure 3:
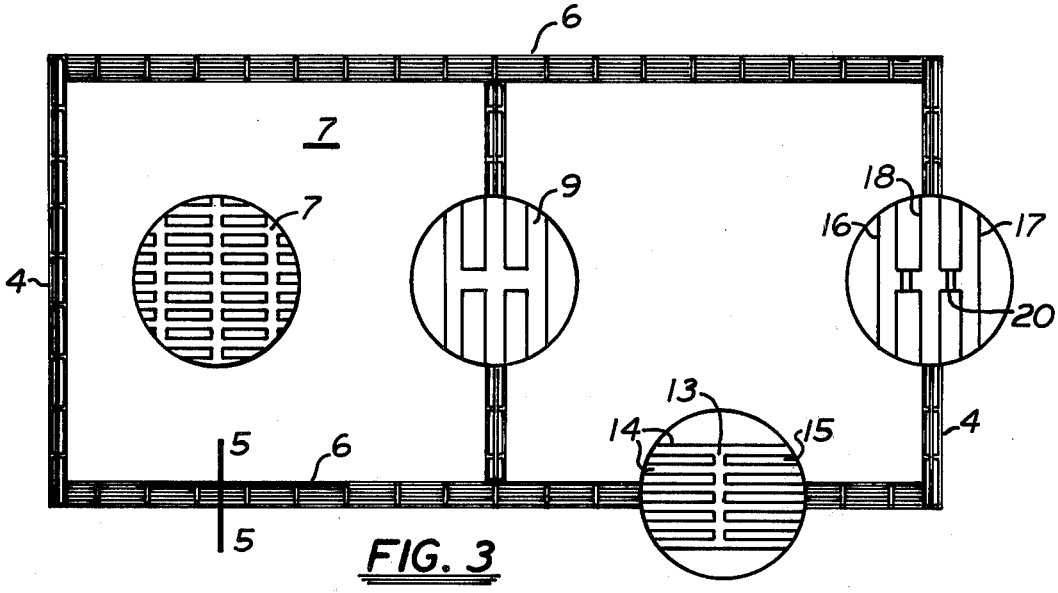
Figure 4:
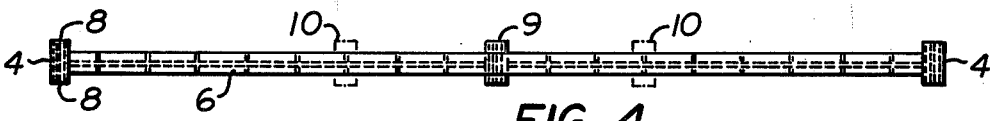
Figure 5:
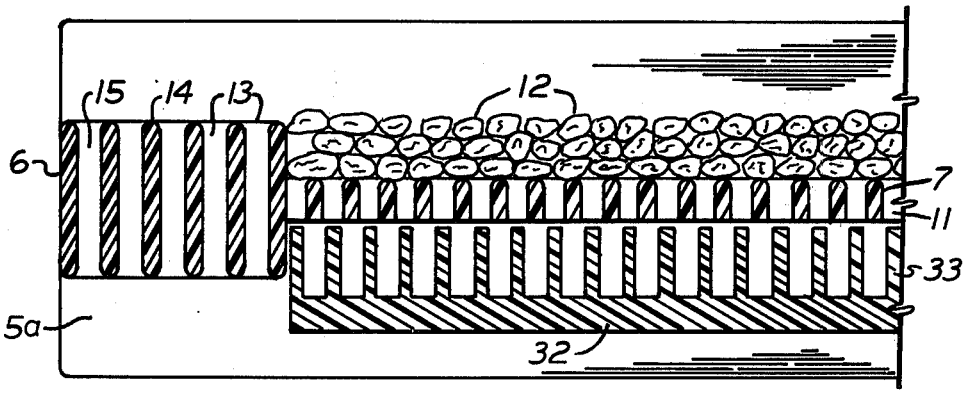
Figure 6:
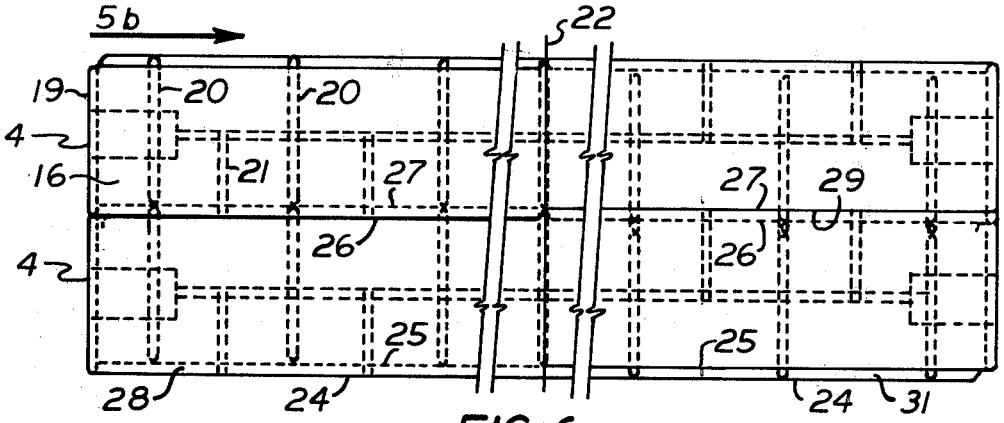
Figure 7:
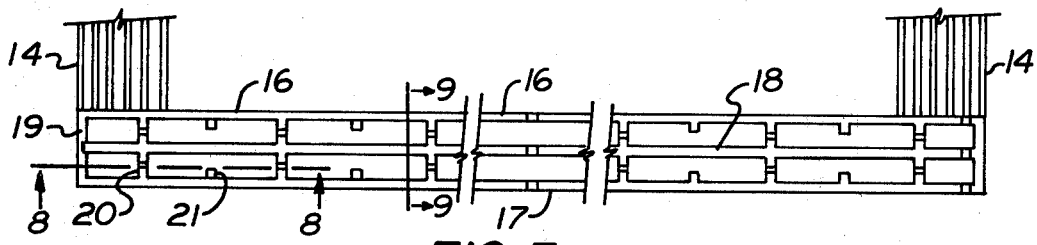
Figure 8:
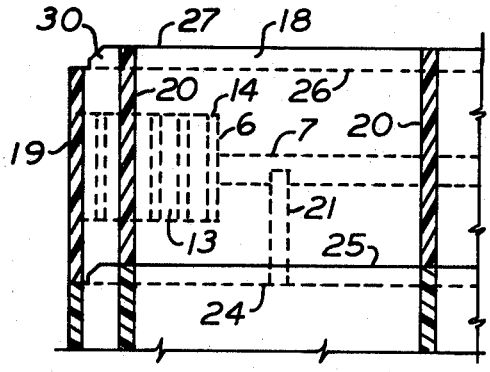
Figure 9:
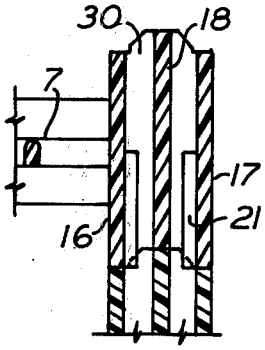
Figure 10:
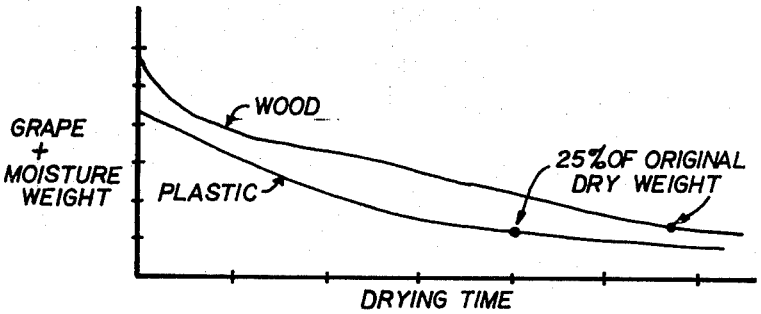

FIG. 1 is a fragmentary side elevation of trucks loaded with trays of fruit in a drying tunnel, FIG. 2 is a fragmentary end elevation of one of the trucks, FIG. 3 is a top plan view of one of the trays, FIG. 4 is an edge view of the tray, FIG. 5 is a section of line 5—5 of FIG. 3 showing fruit (raisins) loaded in the tray, FIG. 6 is an end view of two trays stacked one on top of the other, FIG. 7 is a plan view of the end rail of one of the trays, FIG. 8 and 9 are sections on lines 8—8 and 9—9 of FIG. 7, and FIG. 10 is a drying time curve comparing wood and plastic trays.

In the dried fruit industry fresh raisins, prunes, etc. have been loaded in rectangular wood trays 1 which are stacked twentyfive high on trucks 2 which are butted end to end in a drying tunnel. Approximately 400 trays are required to fill a tunnel. The trays have ⅜" thick load carrying beds 3 secured to end rails 4 three feet long and 3⅛" high and cross rails 5 six feet long by 1¼" high which prevent the fruit from rolling off the bed and also provide slots **5*a* through which heated air flows over the fruit in the direction of arrow 5*b*. In the prior art practice the trays have been made of furniture grade wood. The slots 5*a* line up end to end so that the heated air enters one end of the tunnel, has a laminar flow over the fruit and exits at the other end of the tunnel. In one style, the bottom or bed of the tray is made of 3 inch wide wood slots with one-eighth inch spacing between The end rails 4 (FIG. 7 and 8) have inner and outer longitudinal ribs 16, 17, a longitudinal center rib 18, cross ribs 19 at each end joined to the ribs 16, 17, 18, cross ribs 20 distributed along the length of the rails and joined to the ribs 16, 17, 18, and reinforcing ribs 21 on the inner and outer ribs 16, 17. The ribs 16, 17, 18, 19, 30 form a construction for receiving vertical load from the next upper rail and for transmitting the vertical load to the next lower rail. The ribs 16, 17, 18, 19,20 also form pin and socket connections between each end rail and the next adjacent upper and lower rails. All of the ribs 16, 17, 18, 19, 20** can transmit or receive load.

The end rails are symetrical about a vertical plane 22 perpendicular to the longitudinal axis of the end rails 4. At the leading side of plane 22 as regards the direction of air flow indicated by the arrow **5*b*, the lower ends of longitudinal ribs 16, 17 and end rib 19 lie in a horizontal plane 24. On the trailing side of plane 22, the lower ends of the ribs 16, 17, 19 are stepped upward to lie in a horizontal plane 25. With regard to longitudinal rib 18 and cross ribs 20 the reverse is true. On the leading side of plane 22 the upper ends of the ribs 16, 17, 19 lie in a horizontal plane 26 while on the trailing side of vertical plane 22 the upper ends of the ribs 16, 17, 19 are stepped upward to lie in a higher plane 27. The upper ends of the ribs 18, 20 on the leading side of plane 22 lie in plane 27. The lower ends of ribs 16, 17 and 19 provide a downwardly facing socket 28 on the leading side of plane 22 while the upper ends of ribs 16, 17 and 19 provide an upwardly facing socket 29 on the trailing side of plane 22. The upper ends of ribs 18, 20 provide a pin structure 30 on the leading side of plane 22. The lower ends of ribs 18 and 20 provide a pin structure 31 on the trailing side of plane 22. One end rail 4 of each tray has its downwardly facing socket structure 28 and upwardly extending pin structure 30 on the leading side of plane 22, while the other end rail 4 of each tray has its upwardly facing socket structure 28 and downwardly extending pin structure 30 on the trailing side of plane 22**. By reason of this structure, the pin and socket structures of the trays nest in all positions. That is each tray may be inverted or turned end for end relative to any other tray and the pin and socket structures will nest when the trays are stacked one on top of the other. Also the lowermost tray always has its pin and socket structures resting on a common plane. Either side of the bed of each tray may be in the upwardly facing or load carrying position.

In the prior art, metal trays have been suggested but these are not satisfactory because the raisins tend to burn due to the high heat conductivity of the metal. With the wood trays, as the moisture is removed, juices ooze out of the fruit and form a syrup which hardens and causes the fruit to stick. Machine augers and hand scrapers have been used for removing the dried fruit but these have not been 100% satisfactory. Some fruit remains stuck to the wood trays no matter how carefully the fruit is scraped. Before a tray can be reused, it must be washed. Also the fruit to be dried must be washed before it is loaded into the tray. This has resulted in water absorbed by the tray and water being trapped in the fruit due to the inherently poor drainage of the wood trays. These problems are overcome by the present tray where the tray is molded in one piece from a thermoplastic resin such as polypropylene which does not absorb moisture and as can be seen from FIG. 5 provides good drainage for water on the washed fruit. The fruit is loaded on the uppermost side of the bed 7. The drying with the plastic tray is more efficient because the heated air can contact both the upper and lower sides of the fruit. Tests made on grapes showed a saving of between 25 and 50% in drying time. See FIG. 10. Raisin grapes are considered to be dried when the weight of the dried grapes equals one quarter of the weight of the fresh grapes or in other words when seventy-five percent of the weight has been removed. One reason for the increased drying efficiency of the plastic tray is that there is less moisture to be evaporated because there is a negligible amount of moisture absorbed in the trays and the moisture on the washed grapes easily drains through the openings 11 in the bed. Another reason for efficiency is the better contact between the heated air and the fruit resting on the bed. Specificially, the tests show that the time required to dry the grapes to 25% of their original weight is reduced by 25% when plastic trays are used. That is, if 10 hours were required to dry the grapes in a wooden tray, only 7.5 hours would be required using a plastic tray. About one-third of this savings in drying time is the result of the elimination of the surplus moisture which is present when wooden trays are used. The remaining two-thirds of the savings is the result of the plastic tray design which permits better air circulation. For a 400 tray oven bay, the use of plastic trays will save a minimum of $2.5\times10^6$ BTU of energy ($2.3\times10^3$ $ft^3$ of natural gas), and possibly as much as $7.5\times10^6$ BTU ($6.9\times10^3$ $ft^3$ of natural gas), each time the oven bay is used.

In FIG. 10 the total weight of the grapes plus excess moisture is plotted with the dry weight of the trays subtracted out. It is clear from FIG. 10 that the rate of weight loss from each tray is initially comparable. In fact, the rate of loss from the wooden tray is a little faster for the first two hours. This is because initially it is the surplus water which is lost, not water from the grapes. Because there is so much surplus water in the wooden tray, effective drying of the grapes is retarded at first. After most of the surplus moisture has been removed, the drying rate for the grapes increases. In the case of the plastic tray, effective drying of the grapes begins almost immediately. Furthermore, only after the grapes in the plastic tray are nearly dry does the drying rate of the grapes in the wooden tray equal that of the grapes in the plastic tray. A detailed examination of FIG. 10 shows that the time required for the grapes in the plastic tray to reach 25% of their original weight is only 75% of the corresponding time for the grapes in the wooden tray.

One other detail of the drying process should be mentioned. After several hours in the drying tunnel the wood has lost all its excess moisture. After it is removed and allowed to be exposed to normal air, a significant amount of excess moisture which must be driven off in the drying process. The total absorption of moisture in the wood amounts to about 10–15% of the weight of the grapes. The plastic tray has negligible moisture absorption and for this reason alone must be more efficient than the wood trays.

The plastic tray is quickly unloaded by a piston or punch 32 having pins 33 registering with the slots 11. As the piston is moved upward from the position shown in FIG. 5 each grape is engaged by at least two pins and is bodily lifted off the bed. The precision molding of the plastic tray results in accurate alignment of the pins 33 and slots 11. The close spacing of the slots permitted by the plastic would not be possible in the wood trays now in use.

I claim:

1. A dryer for raisins and the like comprising a drying tunnel with a gas heater for air entering one end of the tunnel and leaving the other end of the tunnel, a plurality of trucks each having a stack of a plurality of fruit holding trays stacked a plurality of trays high, said trucks being butted end to end in said tunnel, each tray having longitudinal end frames at opposite ends of the tray, cross frames of less height than said end frames extending between the ends of said end frames and a fruit holding bed united with said frames, the cross frames of each tray cooperating with the cross frames of the adjoining trays in the stack to provide slots closed at opposite sides by said end frames for the longitudinal flow of air through the stack, said slots between the trays on one truck lining up end to end with the slots between the trays of an adjacent truck, said frames and bed being of thermoplastic having negligible water absorption.

2. The dryer of claim 1 in which each bed has a plurality of openings spaced so each fruit overlies at the upper ends of at least two openings.

3. The dryer of claim 2 in which the openings are elongated slots of width less than half the minimum dimension of the fruit.

4. The dryer of claim 2 in combination with a punch having pins registering with said openings which enter the bottoms of said openings and extend up through said openings and engage the fruit overlying the upper ends of said openings for pushing the fruit off the bed.

5. The dryer of claim 1 in which the bed of each tray is supported by end frames extending in the direction of air flow, each end frame having a set of upwardly directed socket and downwardly directed pin structure at one end and a set of downwardly directed socket and upwardly directed pin structure at the other end, the end frames being oriented so the set of upwardly directed socket and downwardly directed pin structure at one end frame is at the same end of the tray as regards the direction of air flow as the set of downwardly directed socket and upwardly directed pin structure of the other end frame, the end frames and pin and socket structures being of said thermoplastic, and the lowermost ends of the pin and socket structures lying in a common plane.

* * * * *